US010000261B2

(12) United States Patent
Lizzio

(10) Patent No.: US 10,000,261 B2
(45) Date of Patent: Jun. 19, 2018

(54) SYSTEM, METHOD, AND APPARATUS FOR STABILIZING A BOAT

(71) Applicant: Jeffrey Dominic Lizzio, Dunedin, FL (US)

(72) Inventor: Jeffrey Dominic Lizzio, Dunedin, FL (US)

( * ) Notice: Subject to any disclaimer, the term of this patent is extended or adjusted under 35 U.S.C. 154(b) by 0 days. days.

(21) Appl. No.: 15/266,221

(22) Filed: Sep. 15, 2016

(65) Prior Publication Data

US 2017/0080998 A1 Mar. 23, 2017

Related U.S. Application Data

(60) Provisional application No. 62/269,052, filed on Dec. 17, 2015, provisional application No. 62/260,184, filed on Nov. 25, 2015, provisional application No. 62/250,428, filed on Nov. 3, 2015, provisional application No. 62/247,251, filed on Oct. 28, 2015, provisional application No. 62/240,732, filed on Oct. 13, 2015, provisional application No. 62/284,207, filed on Sep. 23, 2015.

(51) Int. Cl.

| | |
|---|---|
| ***B63B 39/06*** | (2006.01) |
| ***B63B 43/04*** | (2006.01) |
| ***B63B 1/04*** | (2006.01) |

(52) U.S. Cl.

CPC ..... *B63B 43/04* (2013.01); *B63B 1/041* (2013.01); *B63B 39/062* (2013.01); *B63B 2039/067* (2013.01); *B63B 2043/042* (2013.01)

(58) Field of Classification Search

CPC ..... B63B 39/062; B63B 2039/067; B63B 2043/042; B63B 43/14

See application file for complete search history.

(56) References Cited

U.S. PATENT DOCUMENTS

| | | | | |
|---|---|---|---|---|
| 2,055,842 A * | 9/1936 | Haislip | ..... | A01K 97/10 224/922 |
| 3,064,613 A * | 11/1962 | Hubick | ..... | B63B 39/06 114/121 |
| 3,568,620 A * | 3/1971 | Douglas | ..... | B63B 39/06 114/125 |
| 4,389,197 A * | 6/1983 | Ballantine | ..... | B63B 1/16 310/57 |
| 8,789,487 B2 | 7/2014 | Lizzio | | |

* cited by examiner

*Primary Examiner* — Andrew Polay

(74) *Attorney, Agent, or Firm* — Larson & Larson, P.A.; Frank Liebenow

(57) ABSTRACT

A stabilizer that extends from the hull of a watercraft below the waterline when needed is disclosed. The stabilizer produces added drag on the watercraft's counteracting a tendency to change bearing. Stabilization chambers of the stabilizer hold semi contained water to produce an extended drag effect by adding lateral weight due to the water that is semi contained within the chamber during use. The restricted flow of water into and out of the stabilizer and the outer dimensions of the stabilizer provides lateral drag to mute any ambient drift.

17 Claims, 15 Drawing Sheets

SYSTEM, METHOD, AND APPARATUS FOR STABILIZING A BOAT

CROSS-REFERENCE TO RELATED APPLICATION

This application claims the benefit of the following U.S. provisional applications: No. 62/284,207 filed on Sep. 23, 2015, 62/240,732 filed on Oct. 13, 2015, 62/247,251 filed Oct. 28, 2015, 62/250,428 filed Nov. 3, 2015, 62/260,184 filed Nov. 25, 2015, and 62/269,052 file Dec. 17, 2015, the disclosure of which are incorporated by reference.

FIELD

This invention relates to the field of watercraft and more particularly to a system for stabilizing a boat when it is on a body of water.

BACKGROUND

Many boats are generally stable when in the water due to the nature, shape, and accessories of the boat. For example, boats that are longer than they are wide, having a V-hull tend to be relatively stable, in that, when at rest, such boats tend to face in one direction and do not shift as the occupants of those boats make movements such as turning their bodies or casting a fishing line. Consider a canoe that, at rest, remains stable except for external forces such as a paddle or a gust of wind.

Stability is an issue when boats having certain hull shapes are used, for example a round boat as disclosed in U.S. Pat. No. 8,789,487, issued Jul. 29, 2014 to Jeffrey Lizzio. In a watercraft that has a generally rounded shape it is at times difficult to keep a bearing and course while not anchored and in a drift. Further, when using the motor to counteract the wind to keep the boat is a desired area; such a watercraft will not easily maintain a heading, especially in windy conditions. Such watercraft styles provide many advantages as described in the above noted reference including efficiency, balance, and buoyancy. To retain these advantages, it is desirable to limit secondary drag or lateral drag that would hinder the watercrafts ability to turn, change direction, and move using minimal engine power.

When steering a round shaped watercraft, force from the motor is transferred faster along the perimeter, making steering and ambient drift more sensitive than that of a boat having a hull perimeter with sharper gradients.

What is needed is a system that will selectively provide enhanced stability to certain watercraft, selectively, when desired.

SUMMARY

A stabilizer is extended from the hull of a watercraft below the waterline when needed to produce added drag and instilling a numbing effect on the watercraft's tendency to change bearing. The stabilizer produces sufficient lateral drag when extended below the waterline by a density that is higher, increasing gravitational pull; and by displacing water, the stabilizer causes lateral drag. Chambers of the stabilizer(s) hold semi contained water to produce an extended drag effect by adding lateral weight due to the water that is semi contained within the chamber during use. The restricted flow of water into and out of the stabilizer and the outer dimensions of the stabilizer provides lateral drag to mute any ambient drift. The stabilizers are preferably constructed as to not significantly add weight to the watercraft, as weight effects top speed, battery life, fuel consumption, etc.

The stabilizer(s) are preferably retractable or removable, moving to and from a position above the waterline and below the waterline by the user of the watercraft. Several ways for deploying and retracting the stabilizer(s) are disclosed.

In one embodiment, a stabilizer for stabilizing a watercraft that is floating in water is disclosed. The stabilizer includes at least one stabilizer chamber, that is at least partially hollow, allowing flow of the water entering the at least one stabilizer chamber when the at least one stabilizer chamber is deployed in the water. A mechanism is connected to the at least one stabilizer chamber for supporting the at least one stabilizer chamber to the watercraft and there is a mechanism for deploying and retracting the at least one stabilizer chamber in and out of the water around the watercraft.

In another embodiment, a method of stabilizing a watercraft is disclosed, the watercraft floating on water. The method includes inserting at least one stabilization chamber into the water such that the water enters the stabilization chamber, and interfacing the stabilization chamber to a surface of the watercraft, thereby maintaining a position of the stabilization chamber relative to the watercraft.

In another embodiment, a stabilizer for stabilizing a watercraft that is floating in water is disclosed. The stabilizer includes at least one stabilizer chamber that is at least partially hollow and allows for a flow of the water entering the at least one stabilizer chamber when the at least one stabilizer chamber is deployed in the water. The at least one stabilizer chamber is connected to a first end of a vertical member and a horizontal member is connected to a second end of the vertical member. An appendage extends from the horizontal member. A second end of the appendage is sized to interface with a hole of the gunnel of the watercraft when the stabilizer is deployed.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
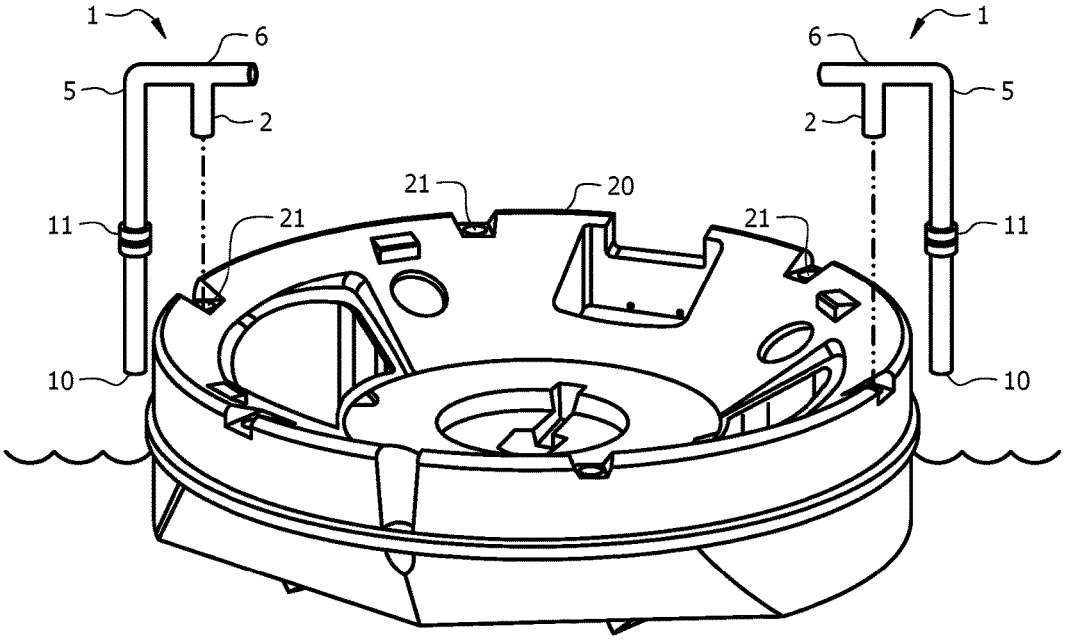
FIG. 1 illustrates a perspective view of a round boat with two stabilizers ready to be inserted for deployment into holes (e.g. into fishing pole holders) within the gunnel walls of the round boat.

Reference will now be made in detail to the presently preferred embodiments of the invention, examples of which are illustrated in the accompanying drawings. Throughout the following detailed description, the same reference numerals refer to the same elements in all figures.

Throughout this description, the stabilizing apparatus are shown augmenting an existing round boat, as described in U.S. Pat. No. 8,789,487, issued Jul. 29, 2014 to Jeffrey Lizzio. The description and drawings use the disclosed round boat as an example, and the stabilizing apparatus disclosed here within are intended for use in many different types of watercraft, especially for use when fishing.

Although several ways for deploying and retracting the stabilizer(s) are disclosed, there are no limitations here within as to the mechanism for performing such deployment. Embodiments shown are typically fabricated from plastic tubing such as furniture-grade PVC tubing and associated mating joints such as elbows and T-joints. These embodiments are provided for explanation of the invention and are in no way limiting, as it is fully anticipated that the stabilizing element(s) be fabricated in many different ways, for example, by molding the stabilizing element as a single piece, etc.

Figure 2:
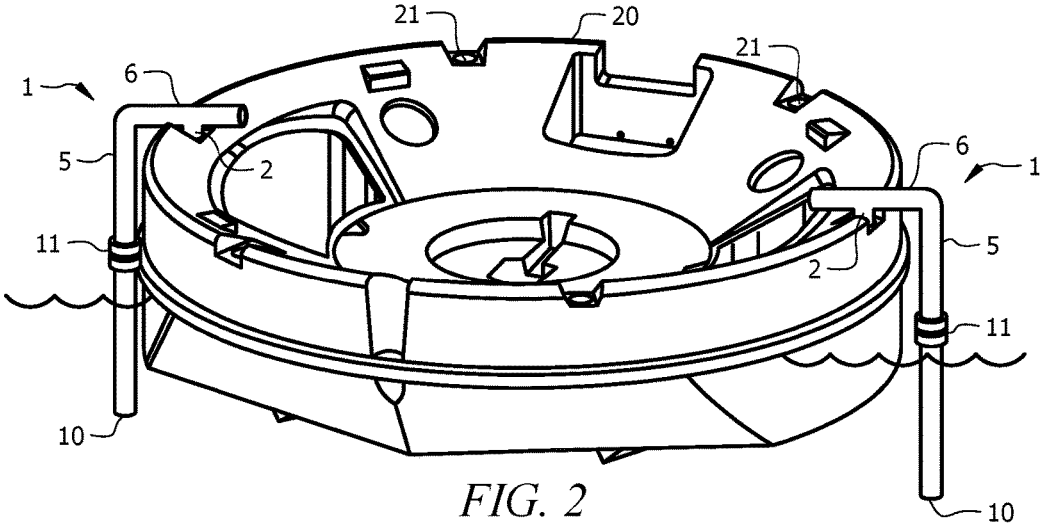
FIG. 2 illustrates a perspective view of the round boat with the two stabilizers inserted for deployment into holes (e.g. into fishing pole holders) within the gunnel walls of the round boat.

Referring to FIGS. 1 and 2, perspective views of a round boat with two stabilizers 1 ready to be inserted for deployment FIG. 1 into holes 21 (e.g. into fishing pole holders) within the gunnel walls of the round boat 21 and inserted and deployed (FIG. 2) into holes 21 (e.g. into fishing pole holders) within the gunnel walls of the round boat 21.

The stabilizers 1 provide stabilization to many types of watercraft, for example the round boat 20 as shown. In the embodiment of FIGS. 1 and 2, the stabilizer includes a single stabilization chamber 10 that is open to allow entry of water. In some embodiments, the vertical portion of the stabilizers 1 include a joint 11 that allows for disassembly, for example when storing the stabilizer 1, while in other embodiments, the vertical portion 5 is a monolithic tube. In this example, the horizontal portion 6 of the stabilizer 1 includes an appendage 2 for inserting into the holes 21 (e.g., fishing pole holders or specifically formed holes) of the round boat 20. By leaving a section of the horizontal portion 6 extending beyond the appendage 2, the section of the horizontal portion 6 that extends beyond the appendage 2 is usable to stow the stabilizer 1 when not in use, as shown in FIGS. 3 and 4.

To allow water penetration into the stabilization chamber 10, the horizontal portion 5 and the vertical portion 6 are hollow, at least hollow enough as to allow air pressure equalization as water enters the stabilization chamber 10. Although there are many ways to provide such equalization, all of which are included here within, in the embodiments shown, the end of the horizontal section 6 is at least partially open, thereby fluidly interfacing the stabilization chamber 10 with the atmosphere and allowing for water to enter the stabilization chamber 10.

Figure 3:
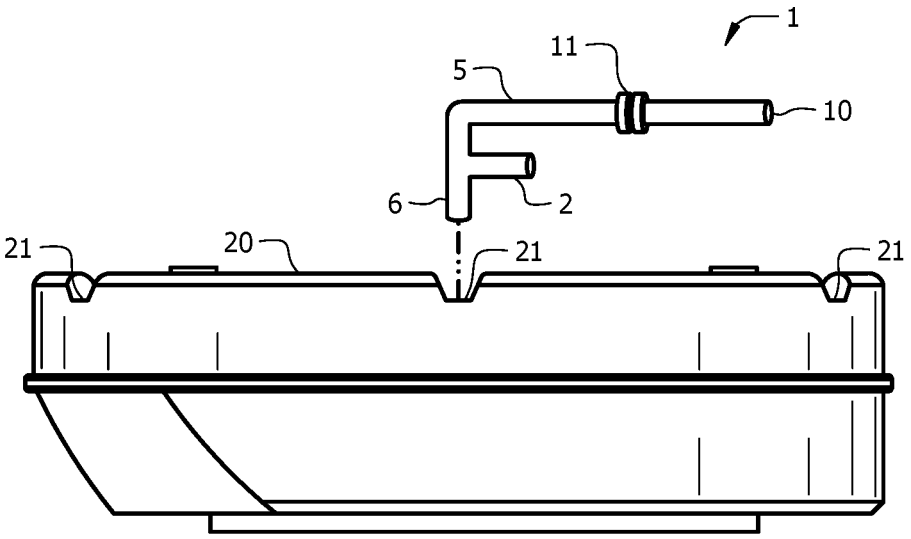
FIG. 3 illustrates a plan view of the round boat with the two stabilizers ready to be inserted into holes within the gunnel walls of the round boat for storage when not being used for stabilization.
Figure 4:
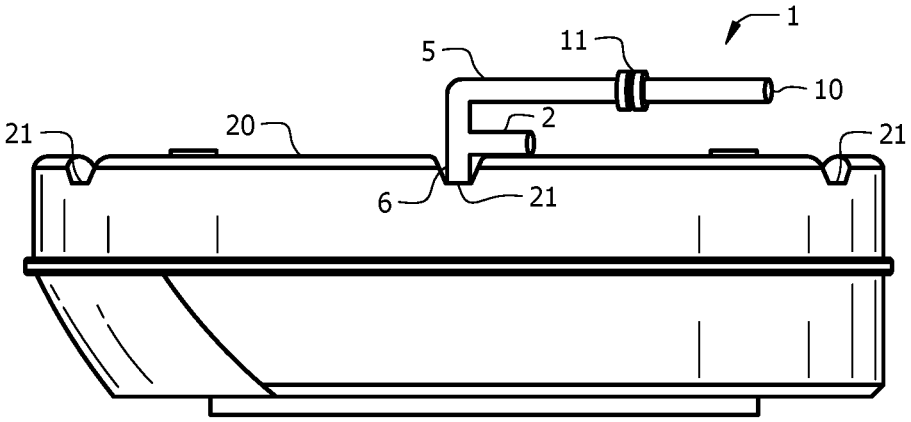
FIG. 4 illustrates a plan view of the round boat with the two stabilizers inserted into holes within the gunnel walls of the round boat for storage when not being used for stabilization.

Referring to FIGS. 3 and 4, plan views of the round boat 20 with the two stabilizers 1. In FIG. 3, the two stabilizers 1 are shown ready to be inserted into holes 21 within the gunnel walls for storage when not being used for stabilization. In FIG. 4, the two stabilizers 1 are shown inserted into holes 21 within the gunnel walls of the round boat 20 for storage when not being used for stabilization. The stabilizers 1 are used stabilize the round boat 20 when stationary or, using a motor (e.g. trolling motor), when controlling drift of the round boat 20. It is desired that the stabilization chambers 10 be lifted out of the water when relocating the round boat 20, improving velocity of the round boat 20 and reducing fuel/electricity consumption. As will be shown in subsequent drawings, there are many ways to effect such removal. In this example, the stabilizers 1 are removed from the holes 21 of the round boat 20, and then the section of the vertical portion 6 that extends beyond the appendage 2 are inserted into the holes 21, stowing the stabilizers 1 as shown in FIG. 4. In this, the stabilization chambers 10 are held out of the water, thereby eliminating any drag that would occur when the round boat 1 is underway.

Figure 5:
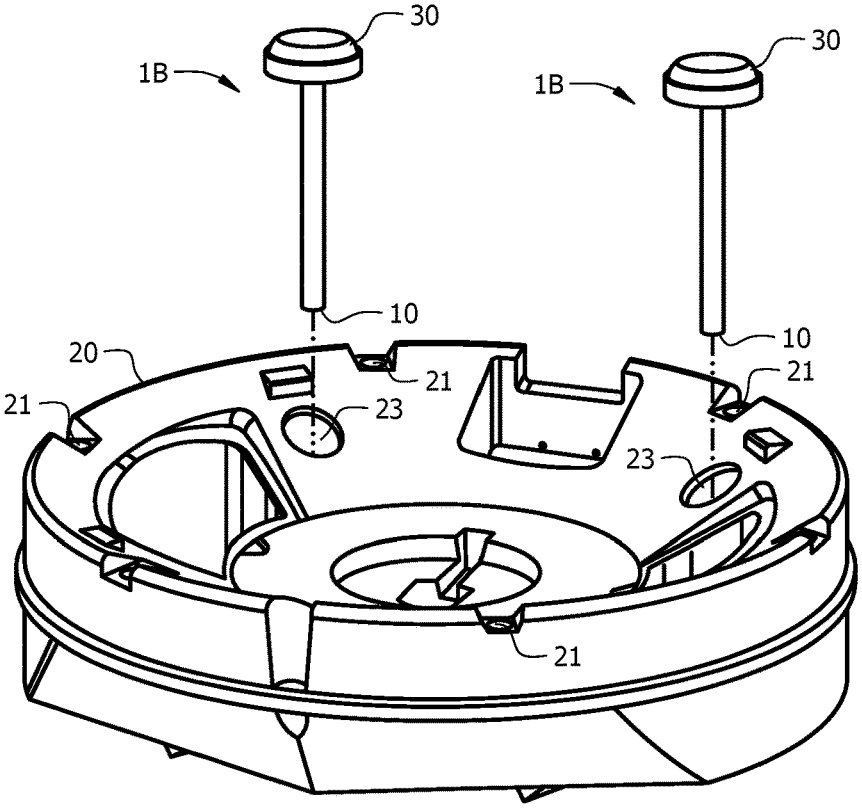
FIG. 5 illustrates a perspective view of a round boat with two stabilizers ready to be inserted for deployment into through-holes (scuppers) within the gunnel walls of the round boat.
Figure 6:
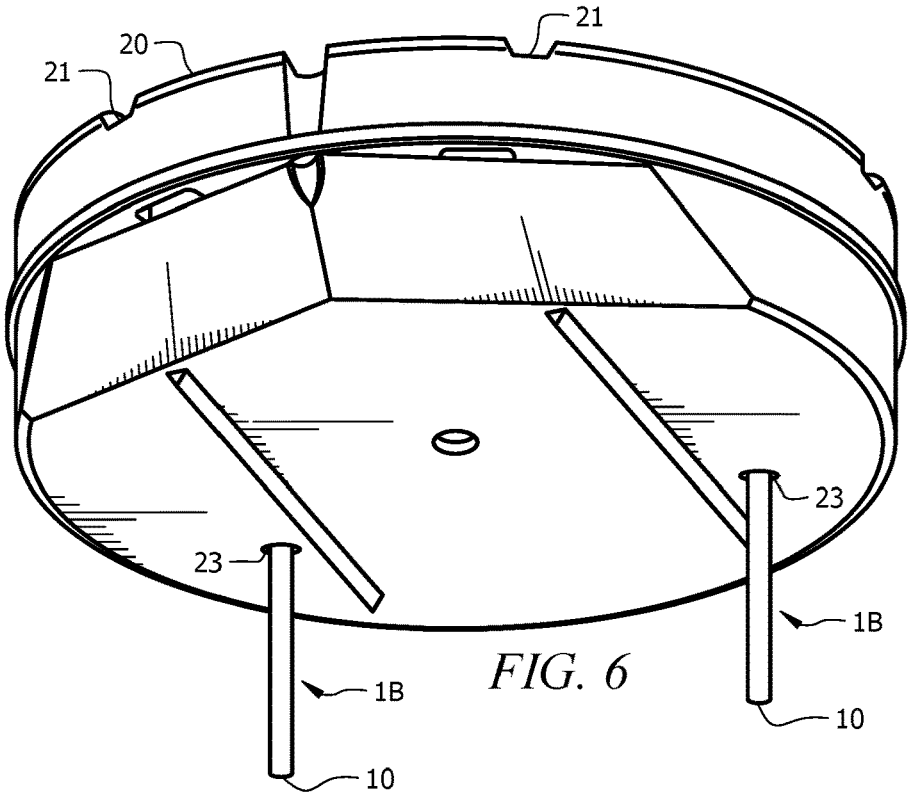
FIG. 6 illustrates a perspective view of the round boat with the two stabilizers inserted and deployed into through-holes (scuppers) within the gunnel walls of the round boat.

Referring to FIGS. 5 and 6, perspective views of a round boat 20 with two stabilizers 1B are shown. In FIG. 5, the two stabilizers 1B are shown ready to be inserted for deployment into through-holes 23 (scuppers). In FIG. 6, the two stabilizers 1B are shown inserted and deployed into through-holes 23 (scuppers). Although any location is anticipated for the through-holes 23, in FIGS. 5 and 6, the through-holes 23 are shown within the gunnel walls of the round boat 20. Each of the stabilizers 1B includes a stabilization chamber 10 as previously described. In some embodiments, a handle 30 is provided on each of the stabilizers 1B to facilitate lifting the stabilizers 1B out of the water when not requiring stabilization (e.g., when underway or on a trailer).

Figure 7:
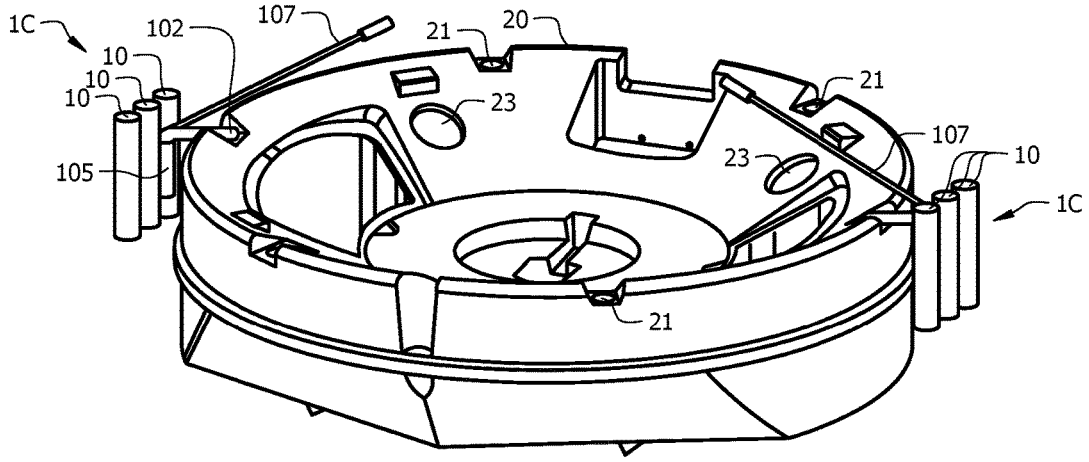
FIG. 7 illustrates a perspective view of the round boat with two stabilizers retracted (above the water line) using a swivel deployment mechanism.
Figure 8:
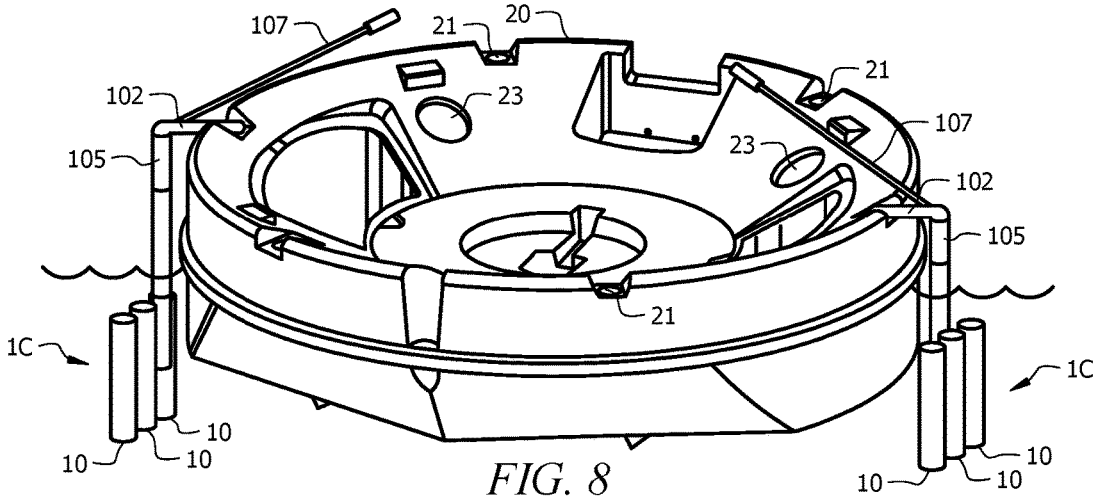
FIG. 8 illustrates a perspective view of the round boat with the two stabilizers deployed (below the water line) using the swivel deployment mechanism.

Referring to FIGS. 7 and 8, perspective views of the round boat 20 with two stabilizers 1C are shown. In FIG. 7, the two stabilizers 1C are shown retracted (above the water line) using a telescoping deployment mechanism 105. In FIG. 8 the two stabilizers 1C are shown deployed (below the water line) using the telescoping deployment mechanism 105. In this version of the stabilizers 1C, there are three stabilization chambers 10 connected in a linear fashion to the telescoping deployment mechanism 105 that telescope for retracting and deployment. A handle 107 facilitates lifting and lowering of the stabilization chambers 10 for retracting and deploying. In this version, the telescoping deployment mechanism 105 is attached to the round boat 20 by an arm 102 that is inserted into a holes 21 (e.g. into fishing pole holders), although any attachment mechanism is equally anticipated.

Figure 9:
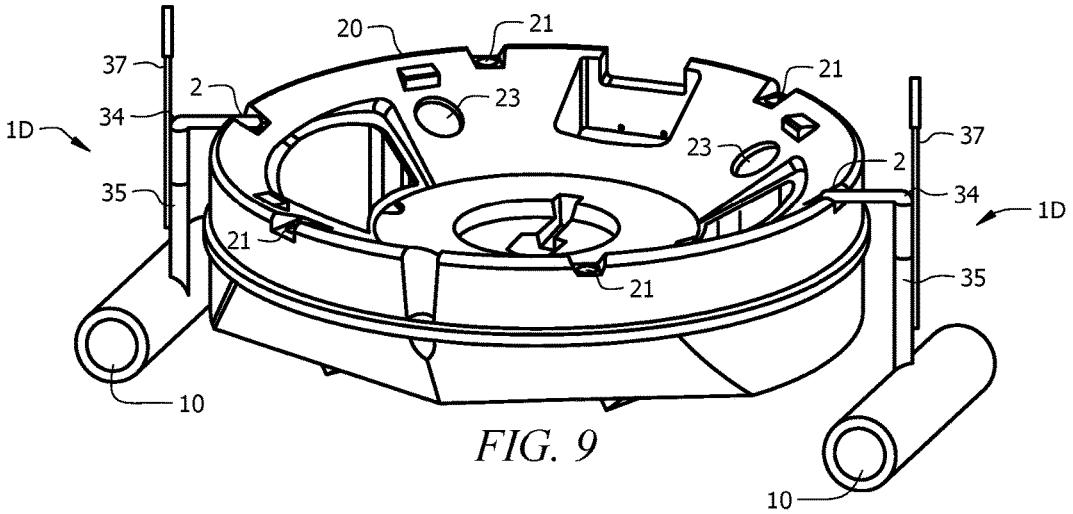
FIG. 9 illustrates a perspective view of the round boat with two stabilizers deployed (below the water line) using the swivel deployment mechanism.
Figure 10:
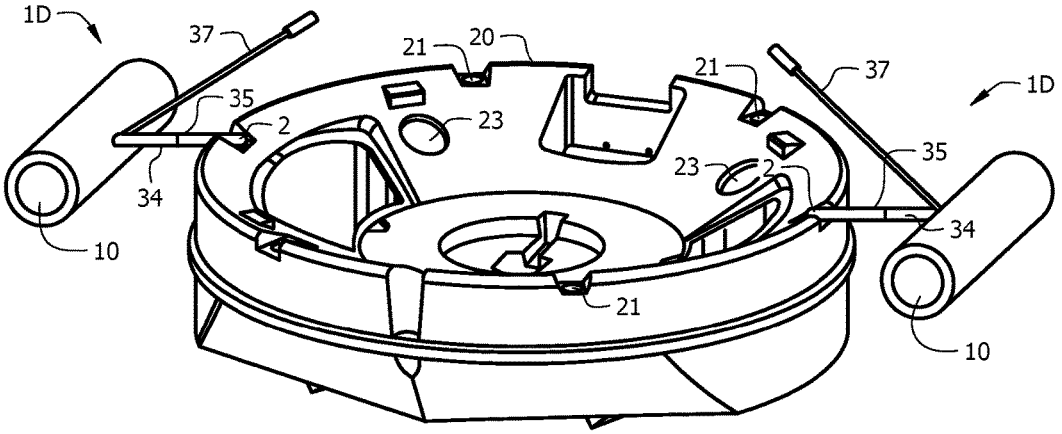
FIG. 10 illustrates a perspective view of the round boat with the two stabilizers retracted (above the water line) using a swivel deployment mechanism.

Referring to FIGS. 9 and 10, perspective views of the round boat 20 with two stabilizers 1D are shown. In FIG. 9, the two stabilizers 1D are shown deployed (below the water line) using the swivel or hinged deployment mechanism 34. In FIG. 10 the two stabilizers 1 are shown retracted (above the water line) using a swivel or hinged deployment mechanism 34. In this version of the stabilizers 1D, there is a horizontal stabilization chamber 10 connected to the swivel or hinged deployment mechanism 34 that hinges or swivels for retracting and deployment. A handle 37 facilitates lifting and lowering of the stabilization chambers 10 for retracting and deploying. In this version, the swivel or hinged deployment mechanism 34 is attached to the round boat 20 by an arm 32 that is inserted into a holes 21 (e.g. into fishing pole holders), although any attachment mechanism is equally anticipated.

Figure 11:
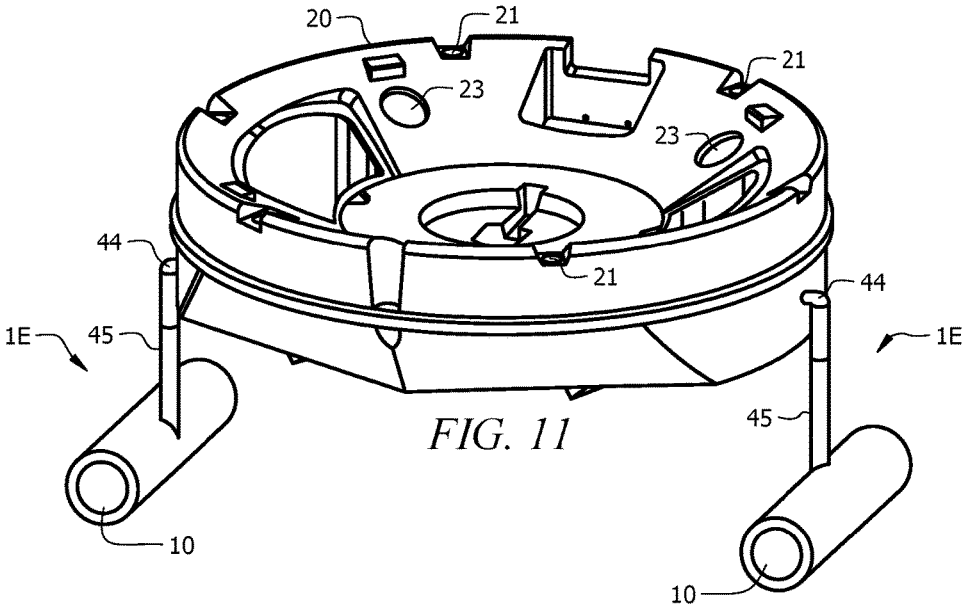
FIG. 11 illustrates a perspective view of the round boat with two stabilizers attached to the hull of the round boat and deployed (below the water line) using a hinged deployment mechanism.
Figure 12:
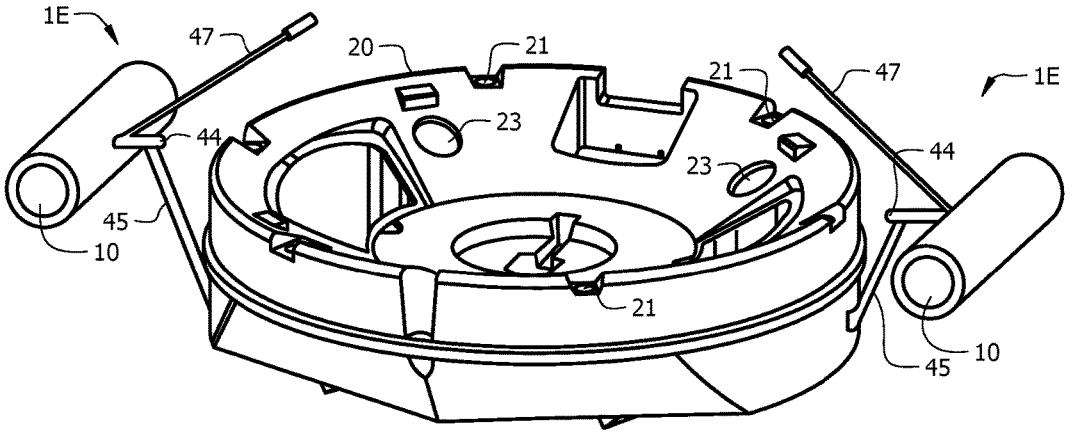
FIG. 12 illustrates a perspective view of the round boat with the two stabilizers attached to the hull of the round boat and retracted (above the water line) using the hinged deployment mechanism.

Referring to FIGS. 11 and 12, perspective views of the round boat 20 with two stabilizers 1E are shown. In FIG. 11 the two stabilizers 1E are shown attached to the hull of the round boat 20 and deployed (below the water line) using a hinged deployment mechanism 44. In FIG. 12 the two stabilizers 1E are shown attached to the hull of the round boat 20 and retracted (above the water line) using the hinged deployment mechanism 44. In this version of the stabilizers 1E, there is a horizontal stabilization chamber 10 connected to the hinged deployment mechanism 44 that hinges for retracting and deployment. A handle 47 facilitates lifting and lowering of the stabilization chambers 10 for retracting and deploying. In this version, the hinged deployment mechanism 44 is attached to the hull of the round boat 20, for example, by a bolt or by a fitting 45, although any attachment mechanism is equally anticipated.

Figure 13:
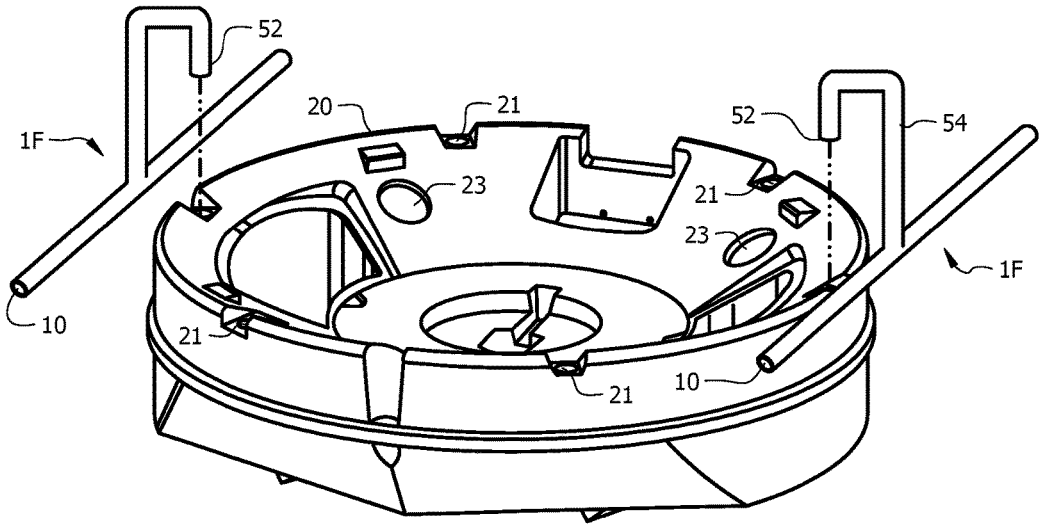
FIG. 13 illustrates a perspective view of the round boat with two horizontal stabilizers ready to be inserted for deployment into holes (e.g. into fishing pole holders) within the gunnel walls of the round boat.
Figure 14:
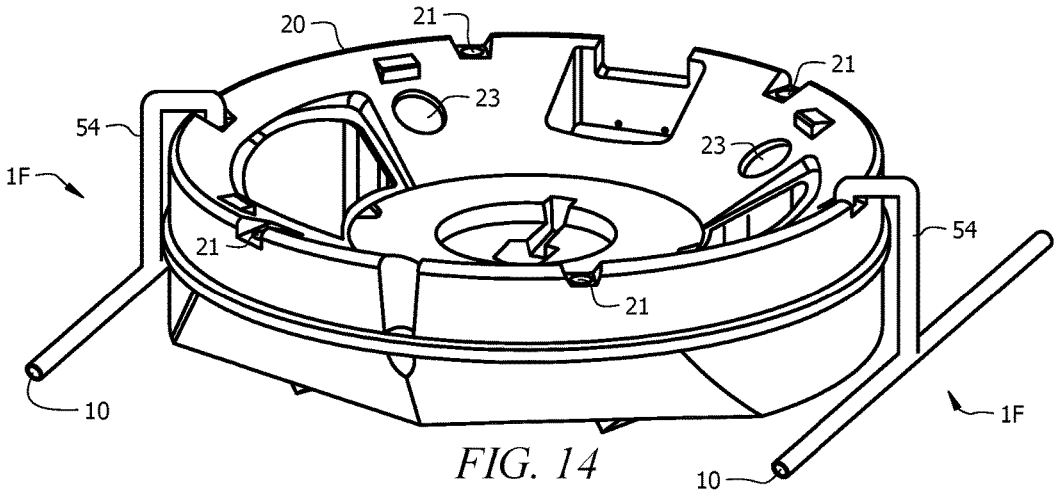
FIG. 14 illustrates a perspective view of the round boat with the two horizontal stabilizers inserted for deployment into holes (e.g. into fishing pole holders) within the gunnel walls of the round boat.

Referring to FIGS. 13 and 14, perspective views of the round boat 20 with two horizontal stabilizers 1F are shown. In FIG. 13, the two stabilizers 1F are shown ready to be inserted for deployment into holes 21 (e.g. into fishing pole holders) within the gunnel walls of the round boat 20. In FIG. 14 the two stabilizers 1F are shown inserted for deployment into holes 21 (e.g. into fishing pole holders) within the gunnel walls of the round boat 20. In this example, the stabilization chambers 10 are shown horizontal and elongated and are interfaced to the round boat 20 connected to an appendage 52 by an arm 54. The appendage 52 fits into the holes 21 (e.g. into fishing pole holders).

Figure 15:
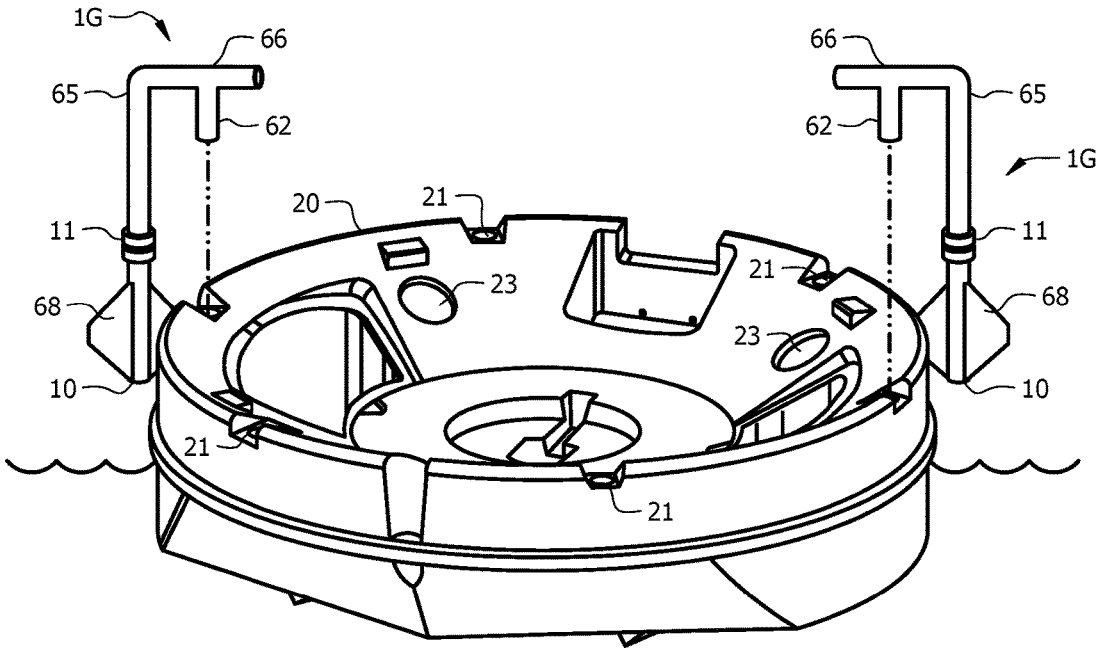
FIG. 15 illustrates a perspective view of a round boat with two stabilizers with fins ready to be inserted for deployment into holes (e.g. into fishing pole holders) within the gunnel walls of the round boat.
Figure 16:
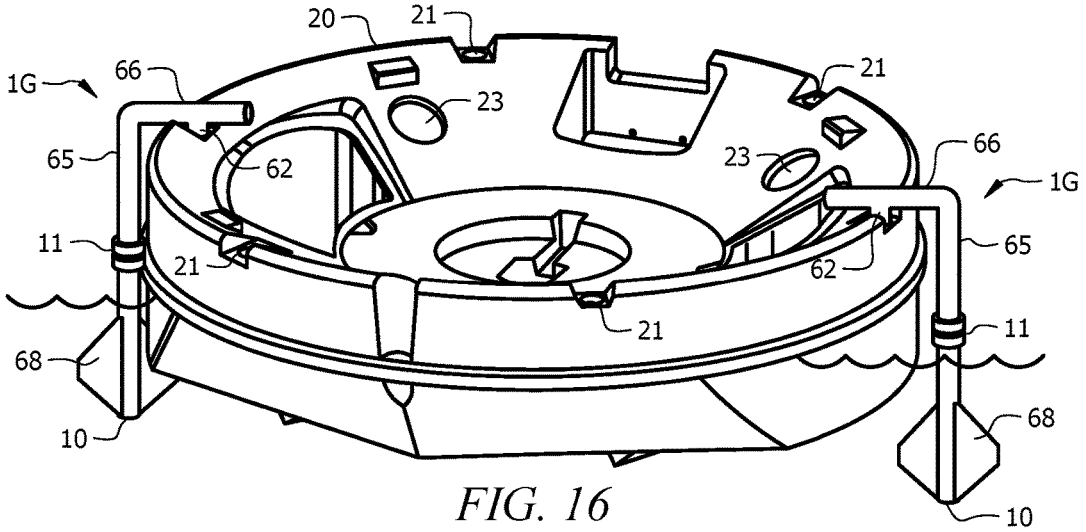
FIG. 16 illustrates a perspective view of the round boat with the two stabilizers with fins inserted for deployment into holes (e.g. into fishing pole holders) within the gunnel walls of the round boat.

Referring to FIGS. 15 and 16, perspective views of a round boat 20 with two stabilizers 1G with fins 68 are shown. In FIG. 15 the two stabilizers 1G with fins 68 are shown ready to be inserted for deployment into holes 21 (e.g. into fishing pole holders) within the gunnel walls of the round boat 20. In FIG. 16 the two stabilizers 1G with fins 68 are shown inserted for deployment into holes 21 (e.g. into fishing pole holders) within the gunnel walls of the round boat 20. In some embodiments, the vertical portion 65 of the stabilizers 1G include a joint 11 that allows for disassembly, for example when storing the stabilizer 1G, while in other embodiments, the vertical portion 65 is a monolithic tube. In this example, the horizontal portion 66 of the stabilizer 1G includes an appendage 62 for inserting into the holes 21 (e.g., fishing pole holders or specifically formed holes) of the round boat 20. By leaving a section of the horizontal portion 66 extending beyond the appendage 62, the section of the horizontal portion 66 that extends beyond the appendage 62 is used to stow the stabilizer 1G when not in use, for example, as shown in FIGS. 3 and 4.

To allow water penetration into the stabilization chamber 10, the horizontal portion 65 and the vertical portion 66 are hollow, at least hollow enough as to allow air pressure equalization as water enters the stabilization chamber 10. Although there are many ways to provide such equalization, all of which are included here within, in the embodiments shown, the end of the vertical section 66 is at least partially open, thereby fluidly interfacing the stabilization chamber 10 with the atmosphere and allowing for water to enter the stabilization chamber 10. The fin 68 provides directional stabilization to the round boat 20.

Figure 17:
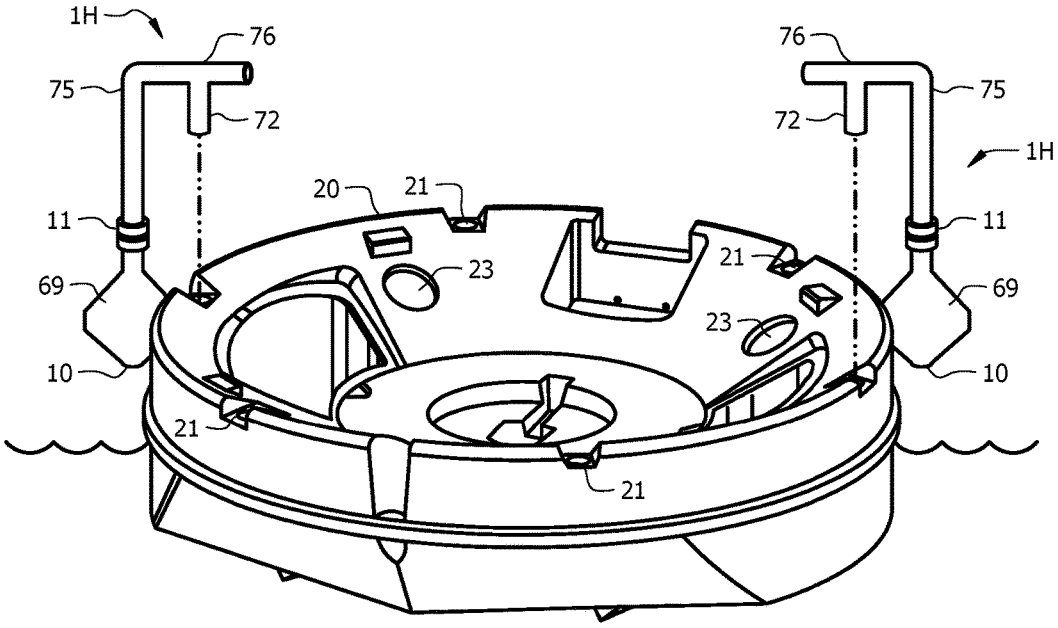
FIG. 17 illustrates a perspective view of a round boat with two fin stabilizers ready to be inserted for deployment into holes (e.g. into fishing pole holders) within the gunnel walls of the round boat.
Figure 18:
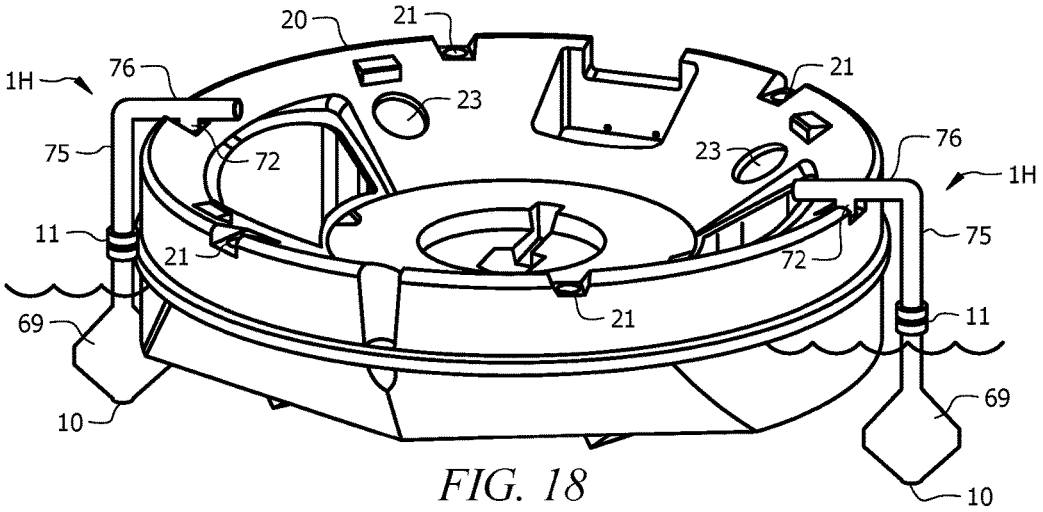
FIG. 18 illustrates a perspective view of the round boat with the two fin stabilizers inserted for deployment into holes (e.g. into fishing pole holders) within the gunnel walls of the round boat.

Referring to FIGS. 17 and 18, perspective views of a round boat 20 with two fin-stabilizers 1 are shown. In FIG. 17, the two fin-stabilizers 1H are shown ready to be inserted for deployment into holes 21 (e.g. into fishing pole holders) within the gunnel walls of the round boat 20. In FIG. 18 the two fin-stabilizers 1H are shown inserted for deployment into holes 21 (e.g. into fishing pole holders) within the gunnel walls of the round boat 20. In some embodiments, the vertical portion 75 of the stabilizers 1H include a joint 11 that allows for disassembly, for example when storing the stabilizer 1H, while in other embodiments, the vertical portion 75 is a monolithic tube. In this example, the horizontal portion 76 of the stabilizer 1H includes an appendage 72 for inserting into the holes 21 (e.g., fishing pole holders or specifically formed holes) of the round boat 20. By leaving a section of the horizontal portion 76 extending beyond the appendage 72, the section of the horizontal portion 76 that extends beyond the appendage 72 is usable to stow the stabilizer 1H when not in use, for example, as shown in FIGS. 3 and 4.

In this version, the fin 69 provides directional stabilization to the round boat 20.

Figure 19:
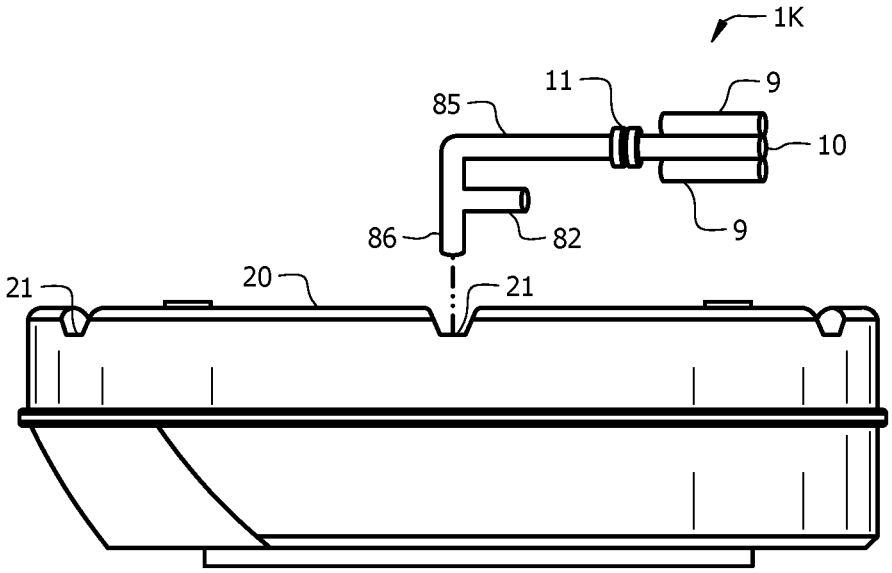
FIG. 19 illustrates a plan view of the round boat with the two stabilizers ready to be inserted into holes within the gunnel walls of the round boat for storage when not being used for stabilization.
Figure 20:
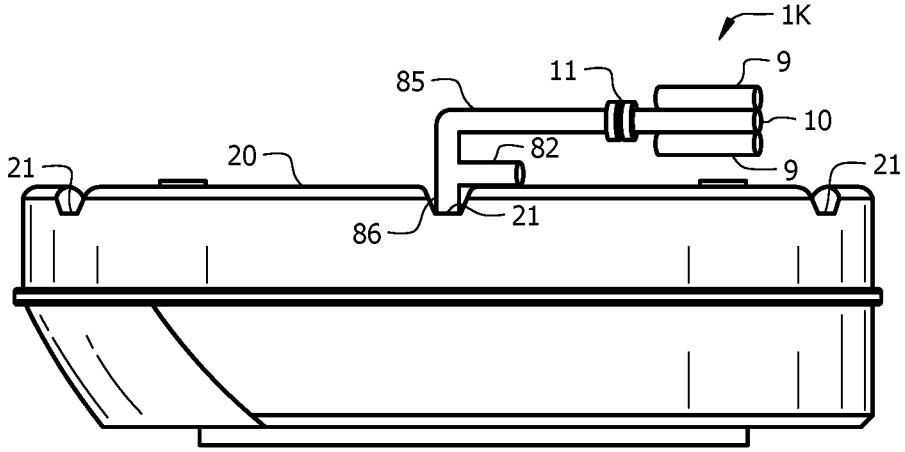
FIG. 20 illustrates a plan view of the round boat with the two stabilizers inserted into holes within the gunnel walls of the round boat for storage when not being used for stabilization.

Referring to FIGS. 19 and 20, plan views of the round boat 20 with the two stabilizers 1K are shown. In FIG. 19, the two stabilizers 1K are shown ready to be inserted into holes 21 within the gunnel walls of the round boat 20 for storage when not being used for stabilization. In FIG. 20 the two stabilizers 1K are shown inserted into holes 21 within the gunnel walls of the round boat 20 for storage when not being used for stabilization.

In some embodiments, the vertical portion 85 of the stabilizers 1K include a joint 11 that allows for disassembly, for example when storing the stabilizer 1K, while in other embodiments, the vertical portion 85 is a monolithic tube. In this example, the horizontal portion 86 of the stabilizer 1K includes an appendage 82 for inserting into the holes 21 (e.g., fishing pole holders or specifically formed holes) of the round boat 20 when deploying the stabilizers 1K. By leaving a section of the horizontal portion 86 extending beyond the appendage 82, the section of the horizontal portion 86 that extends beyond the appendage 82 is usable to stow the stabilizer 1 when not in use, as shown. The stabilizers 1K are deployed as shown in, for example, FIGS. 1 and 2.

To allow water penetration into the stabilization chamber 10, the horizontal portion 85 and the vertical portion 86 are hollow, at least hollow enough as to allow air pressure equalization as water enters the stabilization chambers 10. Although there are many ways to provide such equalization, all of which are included here within, in the embodiments shown, the end of the horizontal section 86 is at least partially open, thereby fluidly interfacing the stabilization chamber 10 with the atmosphere and allowing for water to enter the stabilization chamber 10. In this version, there are two auxiliary stabilization chambers 9 that provide stabilization above that of the stabilization chamber 10. Although the auxiliary stabilization chambers 9 and the stabilization chamber 10 are shown lined up in a linear fashion, any configuration is anticipated, having any number of auxiliary stabilization chambers 9 in any arrangement and size. It is preferred that the auxiliary stabilization chambers 9 be at least partially open at each end to permit water entry and exit.

Figure 21:
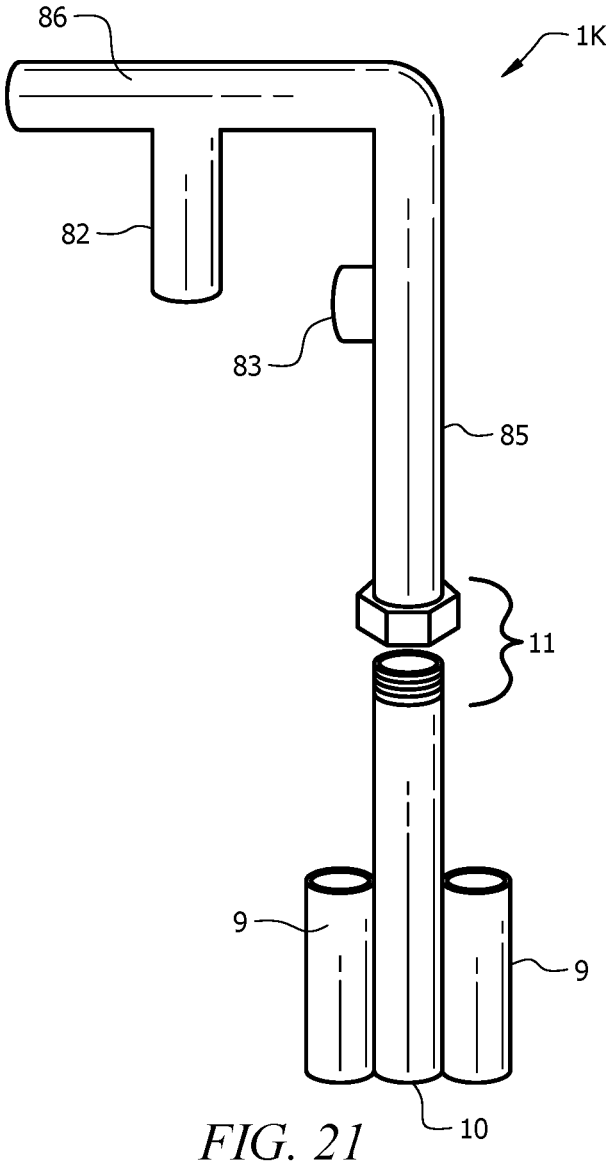
FIG. 21 illustrates a perspective view of a single stabilizer element having a primary stabilization chamber and two auxiliary stabilization chambers.

Referring to FIG. 21, a perspective view of a lone stabilizer 1K having stabilization chamber 10 and two auxiliary stabilization chambers 9 is shown. In this view, the stabilizer 1K is shown disassembled at the joint 11, for example when stowing the stabilizer 1K. Also, this view shows an optional bumper 83 that is present on some stabilizers to hold the stabilizers away from the round boat 20 and keep the stabilizers from moving.

Figure 22A:
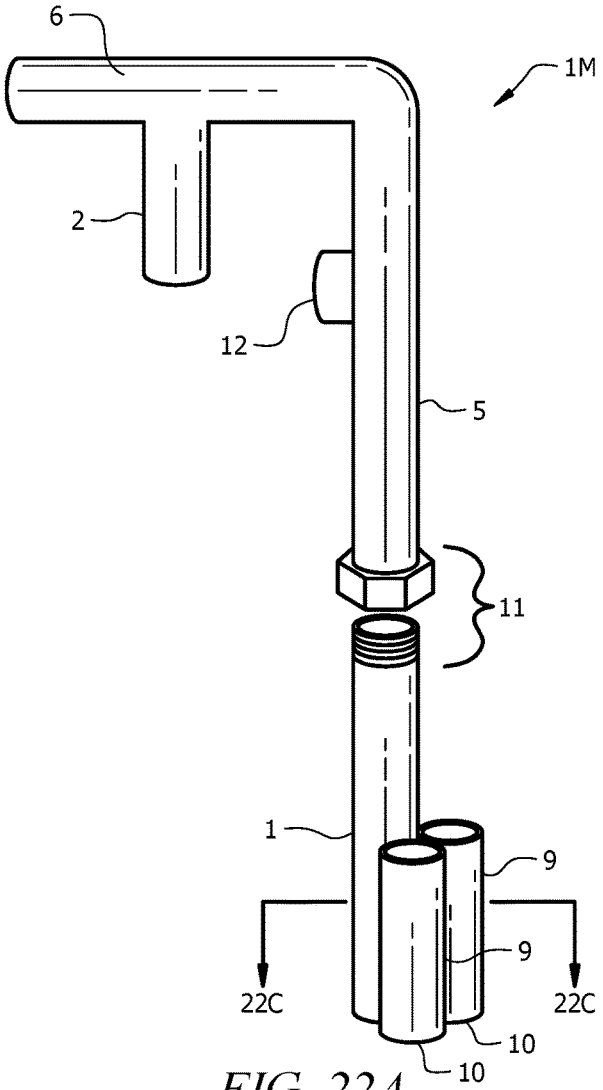
FIG. 22A illustrates a perspective view of a single stabilizer element having multiple stabilization chambers.
Figure 22B:
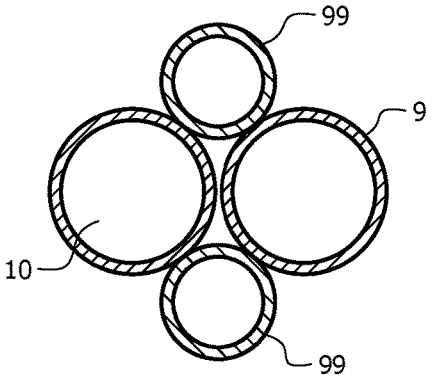
FIG. 22B illustrates a plan view of a configuration of stabilization chambers.
Figure 22C:
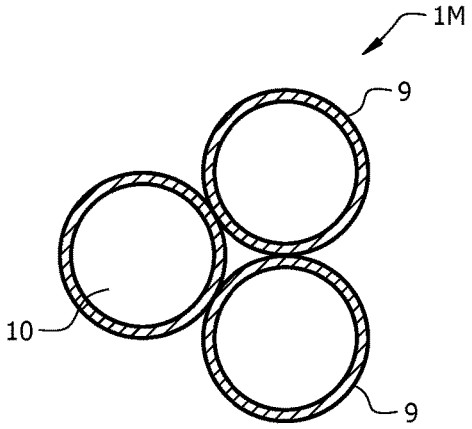
FIG. 22C illustrates a plan view of a configuration of stabilization chambers.

Referring to FIG. 22A, a perspective view of a lone stabilizer 1M having multiple auxiliary stabilization chambers 9 is shown. There are many anticipated configurations of stabilization chambers and auxiliary stabilization chambers 9, as some have been shown and are shown in subsequent figures as examples. In this view, the stabilizer 1M is shown disassembled at the joint 11, for example when stowing the stabilizer 1M. The stabilizer 1M is shown with two equally sized auxiliary stabilization chambers 9, a cross sectional view of such is shown in FIG. 22C. In FIG. 22B a cross sectional view of another configuration of stabilization chambers is shown with the stabilization chamber 10, an auxiliary stabilization chamber 9 having substantially the same cross-sectional size as the stabilization chamber 10 and two auxiliary stabilization chamber 99 having smaller same cross-sectional size as the stabilization chamber 10. Any width, length, and shape of stabilization chamber 10 and auxiliary stabilization chamber 9 is anticipated and examples are shown in the figures.

Figure 23:
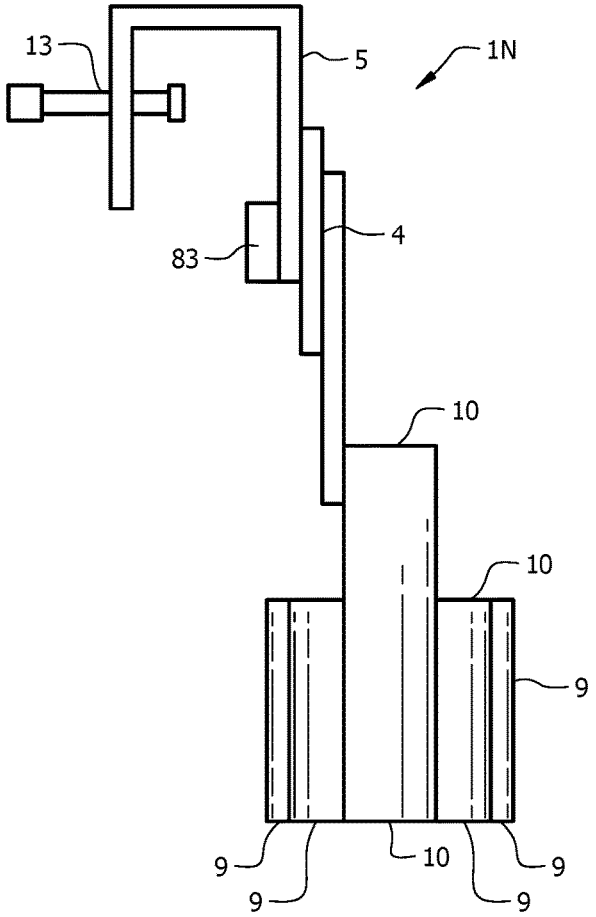
FIG. 23 illustrates a plan view of a stabilizer that attaches with a clamp to the gunnel of the watercraft and extends/retracts through telescoping action.
Figure 24:
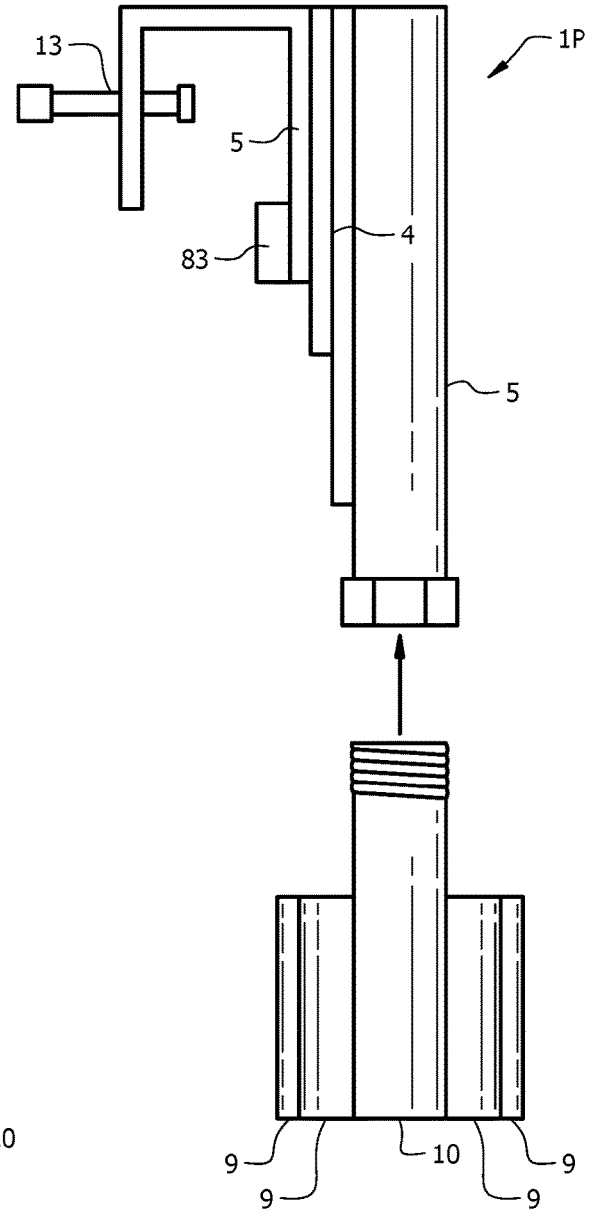
FIG. 24 illustrates a plan view of a stabilizer with removable stabilization chambers that attaches with a clamp to the gunnel of the watercraft and extends/retracts through telescoping action.

Referring to FIGS. 23 and 24, plan views of stabilizers 1N/1P that attach with a clamp 13 to the gunnel of the watercraft and extend/retract through collapsing action are shown. In FIG. 23, the entire stabilization chamber 10/9 of the stabilizer 1N is lowered below the water level by extending the collapsible stages 4. In FIG. 24, the stabilization chamber 10/9 of the stabilizer 1P interfaces to the vertical riser 5 through a connection interface 11. Both stabilizers 1N/1P attach to the gunnel of a watercraft by a clamp 13.

Figures 25, 26:
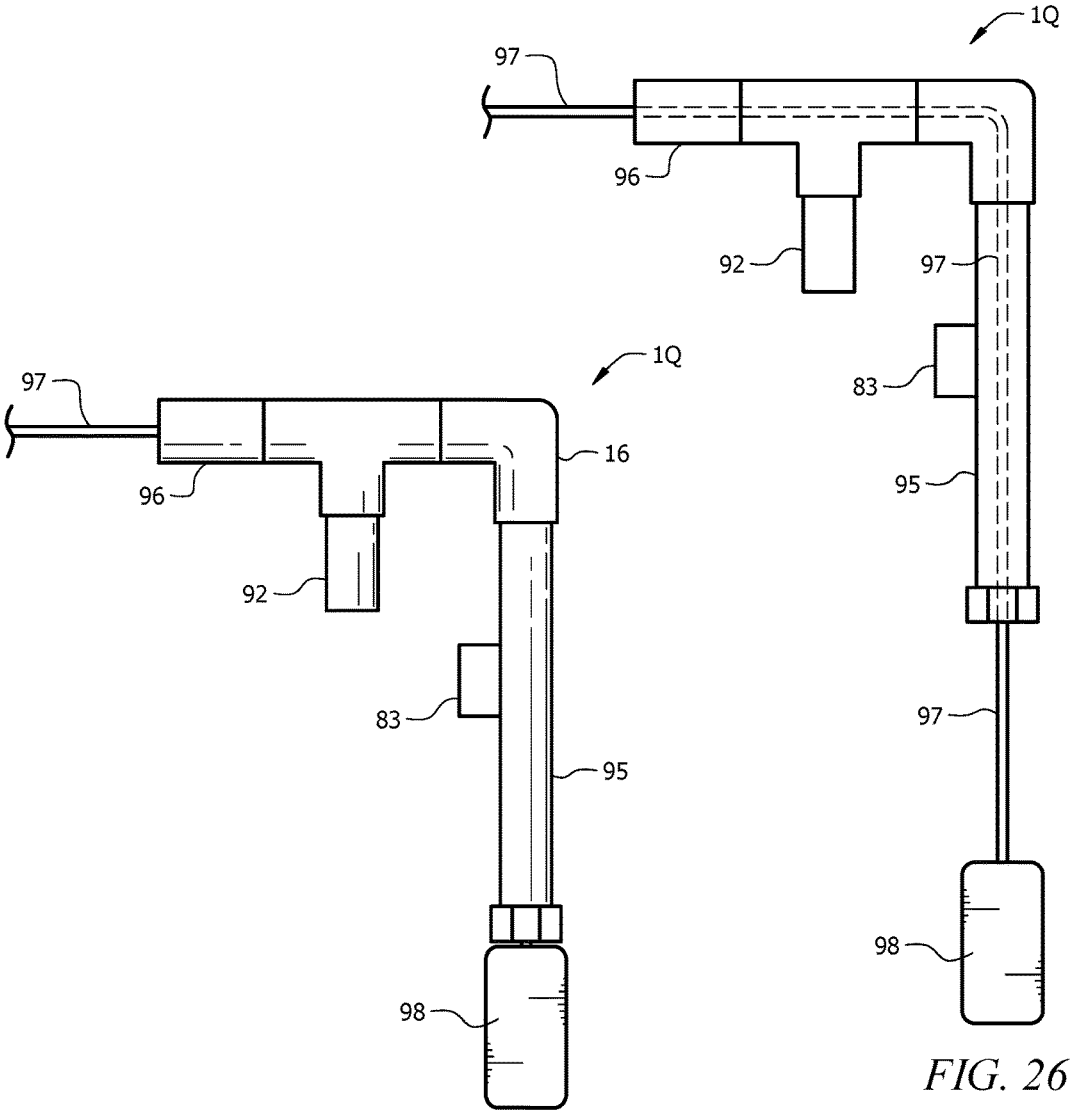
FIG. 25 illustrates a plan view of a stabilizer with mass being in a retracted position, held by a rope running through the handle of the stabilizer.
FIG. 26 illustrates a plan view of a stabilizer with mass being in a deployed position, held by a rope running through the handle of the stabilizer.

Referring to FIGS. 25 and 26, plan views of a stabilizer 1Q with mass 17 are shown. In FIG. 25, the mass 98 is shown in a retracted position, held by a rope 97 running through the stabilizer 1Q. In FIG. 26 the mass 98 is shown in a deployed position. In the versions of FIGS. 25 and 26, the stabilizer 1Q includes a single stabilization chamber 10 that is open to allow entry of water, although any configuration of stabilization chamber(s) 10/9 is anticipated. In this embodiment, the vertical portion 95 is a monolithic tube. The horizontal portion 96 of the stabilizer 1Q includes an appendage 92 for inserting into the holes 21 (e.g., fishing pole holders or specifically formed holes) of the round boat 20. By leaving a section of the horizontal portion 96 extending beyond the appendage 92, the section of the horizontal portion 96 that extends beyond the appendage 92 is usable to stow the stabilizer 1Q when not in use, for example as shown in FIGS. 3 and 4.

To allow water penetration into the stabilization chamber 10, the horizontal portion 95 and the vertical portion 96 are hollow, at least hollow enough as to allow air pressure equalization as water enters the stabilization chamber 10. Although there are many ways to provide such equalization, all of which are included here within, in the embodiments shown, the end of the horizontal section 96 is at least partially open, thereby fluidly interfacing the stabilization chamber 10 with the atmosphere and allowing for water to enter the stabilization chamber 10.

In this embodiment a mass 98 (e.g. weight) is attached to a line 97 (e.g. rope) and the line passes through the vertical section 96 and the horizontal riser 95 for raising and lowering the mass 97.

Figure 27:
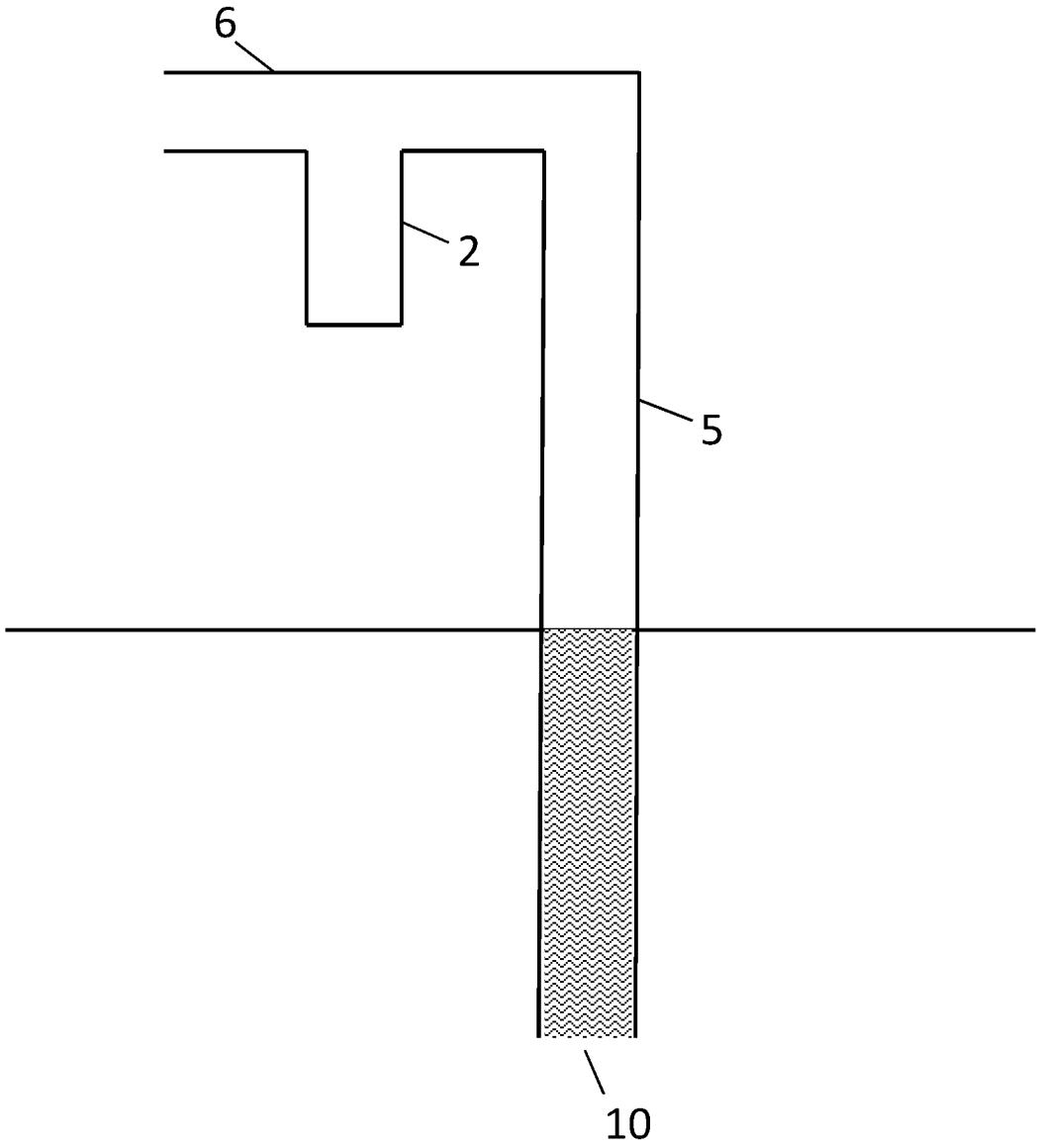
FIG. 27 illustrates a cut-away view of a stabilizer with respect to the water line when deployed.

Referring to FIG. 27, a cut-away view of a stabilizer 1 is shown with respect to the water line after being deployed. Once deployed below the water line, the stabilization chamber 10 fills with water to an equal level with the water line as the horizontal section 6 is at least partially open to the atmosphere and the horizontal section 6 and the vertical riser 5 are at least partially hollow to fluidly connect the stabilization chamber 10 with the atmosphere.

In this description, various examples are provided for ways to fabricate the stabilizer. Although generally shown using tubing, such as PVC tubing (plumbing or furniture grade), any material and construction technique is anticipated, including using members that are not cylindrical (e.g. having triangular, square, rectangular, octagonal, hexagonal, shape). Further, although individual components are anticipated, it is also anticipated that the entire stabilizer be molded as one piece. Further, although shown throughout interfaced or interfacing to a round boat 20, the stabilizers are anticipated for use with any known or future watercraft.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A stabilizer for stabilizing a watercraft that is floating in water, the stabilizer comprising:

at least one stabilizer chamber, the at least one stabilizer chamber being at least partially hollow and allowing flow of the water entering the at least one stabilizer chamber when the at least one stabilizer chamber is deployed in the water;

means for supporting the at least one stabilizer chamber to the watercraft;

means for deploying and retracting the at least one stabilizer chamber from the water around the watercraft; and one or more auxiliary stabilizer chambers affixed to the stabilizer chamber, wherein each of the one or more auxiliary stabilizer chambers is hollow and is open at both ends;

wherein the means for supporting the at least one stabilizer chamber comprises a horizontal member, a first end of the horizontal member extends at a substantially right angle from an end of a vertical member, and an appendage emanating from the horizontal member for inserting into a hole in the watercraft.

2. The stabilizer of claim 1, wherein the stabilizer chamber is a hollow cylindrical tube.

3. The stabilizer of claim 1, wherein the stabilizer chamber is an extension of the vertical member.

4. The stabilizer of claim 1, wherein the vertical member further comprises a joint for separating the vertical member into two sections for storage when not in use.

5. The stabilizer of claim 1, further comprising a bumper affixed to the vertical member for interfacing with a hull of the watercraft.

6. The stabilizer of claim 2, further comprising at least one fin affixed to the stabilization chamber.

7. The stabilizer of claim 1, wherein each of the one or more auxiliary stabilizer chambers is cylindrical.

8. A method of stabilizing a watercraft, the watercraft floating on water, the method comprising:

inserting at least one stabilization chamber into the water, whereas the water enters the stabilization chamber, at least one auxiliary stabilization chamber wherein each of the at least one auxiliary stabilizer chamber is hollow and is open at both ends; and connecting the stabilization chamber to a surface of the watercraft, thereby maintaining a position of the stabilization chamber relative to the watercraft;

whereas the step of maintaining the position is performed by a vertical member interfaced between a horizontal member and the stabilization chamber, the horizontal member removably interfaced to a fishing pole holder of the watercraft.

9. The method of claim 8, further comprising a step of storing, the step of storing comprising inserting an end of the horizontal member into the fishing pole holder of the watercraft, thereby the stabilization chamber is moved out of the water.

10. The stabilizer of claim 8, wherein each of the one or more auxiliary stabilizer chambers is cylindrical.

11. A stabilizer for stabilizing a watercraft that is floating in water, the stabilizer comprising:

at least one stabilizer chamber, the at least one stabilizer chamber being at least partially hollow and allowing flow of the water entering the at least one stabilizer chamber when the at least one stabilizer chamber is deployed in the water;

a vertical member, the at least one stabilizer chamber connected to a first end of the vertical member;

a horizontal member, a first end of the horizontal member connected to a second end of the vertical member;

an appendage, a first end of the appendage connected to the horizontal member and a second end of the appendage sized to interface with a hole of a gunnel of the watercraft; and one or more auxiliary stabilizer chambers affixed to the stabilizer chamber, wherein each of the one or more auxiliary stabilizer chambers is hollow and is open at both ends.

12. The stabilizer of claim 11, wherein the stabilizer chamber the horizontal member, the vertical member, the appendage, and the stabilization chambers are hollow cylindrical tubes.

13. The stabilizer of claim 12, wherein the vertical member further comprises a joint for separating the vertical member into two sections for storage when not in use.

14. The stabilizer of claim 12, further comprising a bumper affixed to the vertical member for interfacing with a hull of the watercraft.

15. The stabilizer of claim 11, wherein at least one of the one or more auxiliary stabilizer chambers has a different size than a size of the stabilizer chamber.

16. The stabilizer of claim 11, wherein the watercraft is a round boat.

17. The stabilizer of claim 11, wherein each of the one or more auxiliary stabilizer chambers is cylindrical.

* * * * *